US010775026B2

(12) United States Patent
Ragazzi

(10) Patent No.: US 10,775,026 B2
(45) Date of Patent: Sep. 15, 2020

(54) MOON APPEARANCE GENERATING SYSTEM

(71) Applicant: COELUX S.R.L., Lomazzo (CO) (IT)
(72) Inventor: Paolo Ragazzi, Lomazzo (IT)
(73) Assignee: CoeLux S.r.l., Lomazzo (CO) (IT)

( * ) Notice: Subject to any disclaimer, the term of this patent is extended or adjusted under 35 U.S.C. 154(b) by 0 days.

(21) Appl. No.: 16/464,476
(22) PCT Filed: Dec. 12, 2017
(86) PCT No.: PCT/EP2017/082396
§ 371 (c)(1),
(2) Date: May 28, 2019
(87) PCT Pub. No.: WO2018/108891
PCT Pub. Date: Jun. 21, 2018

(65) Prior Publication Data

US 2019/0376664 A1 Dec. 12, 2019

(30) Foreign Application Priority Data

Dec. 13, 2016 (EP) ..... 16203825

(51) Int. Cl.
*F21V 9/40* (2018.01)
*F21S 8/02* (2006.01)
(Continued)

(52) U.S. Cl.
CPC ..... *F21V 9/40* (2018.02); *F21S 8/026* (2013.01); *F21V 3/00* (2013.01); *F21V 7/0008* (2013.01);
(Continued)

(58) Field of Classification Search
CPC .... F21S 8/026; F21V 9/00; F21V 9/02; F21V 9/08; F21V 9/40
See application file for complete search history.

(56) References Cited

U.S. PATENT DOCUMENTS 10,533,728 B2 * 1/2020 Yamauchi ..... F21V 9/02
2012/0025838 A1 * 2/2012 Lee ..... F21S 8/006 324/501
(Continued)

FOREIGN PATENT DOCUMENTS

CN 104565997 A 4/2015
WO 2009156347 A1 12/2009
(Continued)

OTHER PUBLICATIONS

Remko Dinkla, European International Searching Authority, International Search Report and Written Opinion, corresponding PCT Application No. PCT/EP2017/082396, dated Jan. 26, 2018, 14 pages total.

*Primary Examiner* — Mariceli Santiago
(74) *Attorney, Agent, or Firm* — DiBerardino McGovern IP Group LLC

(57) ABSTRACT

In an aspect, a moon appearance generating system (1) is configured for providing an enhanced depth perception to imitate a sky scene, for example, a natural sky scene at night. The moon appearance generating system (1) comprises a luminous device (7) with a primary light emitting area (9) that is configured to provide, when the moon appearance generating system (1) is operated to imitate the sky scene, a two-dimensional spatial profile of a luminous flux density across the primary light emitting area (9) with a mean luminous flux density value of at least 5 lm/m2, a maximum luminous flux density value of less than about 150000 lm/m2, wherein the mean luminous flux density value is at least 2% of the maximum luminous flux density value; and a frame structure (25) providing an exit aperture (5) through which the primary light emitting area (9) is completely viewable from within an enhanced depth perception observation range (33), wherein the exit aperture (5) is associated with an inner frame line (25A) that surrounds at least an area of 20 cm width and 20 cm height.

30 Claims, 4 Drawing Sheets

(51) Int. Cl.

| | |
|---|---|
| ***F21V 3/00*** | (2015.01) |
| ***F21V 7/00*** | (2006.01) |
| ***F21V 9/08*** | (2018.01) |
| ***F21W 121/00*** | (2006.01) |

(52) U.S. Cl.
CPC ..... *F21V 9/08* (2013.01); *F21W 2121/008* (2013.01)

(56) References Cited

U.S. PATENT DOCUMENTS

| | | | | |
|---|---|---|---|---|
| 2014/0133125 | A1* | 5/2014 | Di Trapani | F21V 7/06 362/2 |
| 2014/0226336 | A1* | 8/2014 | Chi | F21K 9/65 362/280 |
| 2016/0227618 | A1 | 8/2016 | Meerbeek et al. | |
| 2017/0051893 | A1* | 2/2017 | Di Trapani | F21V 9/02 |
| 2018/0335188 | A1* | 11/2018 | Di Trapani | F21V 7/0008 |
| 2018/0345630 | A1* | 12/2018 | Di Trapani | F21V 9/02 |

FOREIGN PATENT DOCUMENTS

| | | | |
|---|---|---|---|
| WO | 2009156348 | A1 | 12/2009 |
| WO | 2014076656 | A1 | 5/2014 |
| WO | 2015172794 | A1 | 11/2015 |
| WO | 2015173770 | A2 | 11/2015 |
| WO | 2016134733 | A1 | 9/2016 |

* cited by examiner

MOON APPEARANCE GENERATING SYSTEM

TECHNICAL FIELD

The present disclosure relates generally to systems providing a specific optical perception, and in particular to systems for providing a moon appearance. Moreover, the present disclosure relates generally to implementing a predesigned luminous intensity profile of a light source.

BACKGROUND

Artificial lighting systems are known for simulating natural lighting such as sunlight illumination. Exemplary embodiments of such lighting systems using, for example, Rayleigh-like diffusing layers are disclosed in several applications such as WO 2009/156347 A1, WO 2009/156348 A1, and WO 2014/076656 A1, filed by the same applicants. The therein disclosed lighting systems use, for example, a light source producing visible light, and a panel containing nanoparticles used in transmission or reflection. During operation of those lighting systems, the panel receives the light from the light source and acts as a so-called Rayleigh diffuser, namely it diffuses incident light similarly to the earth atmosphere in clear-sky conditions.

To provide for a sun-like impression, the light sources may be designed for a sun-like perception such as disclosed in WO 2015/172794 A1 filed by the same applicants. As disclosed therein, a detailed analysis and a plurality of optical measures were implemented to achieve the desired sun-like perception of the aperture of the high luminance light source.

High luminance applications stand in contrast to low luminance applications that need to be considered when imitating, for example, a natural sky scene at night. The herein disclosed concepts are designed further to achieve an enhanced depth perception even for low luminance applications.

Thus, the present disclosure is directed, at least in part, to improving or overcoming one or more aspects of prior systems.

SUMMARY OF THE DISCLOSURE

In a first aspect, the present disclosure is directed to a moon appearance generating system for providing an enhanced depth perception to imitate a natural scene at night. The moon appearance generating system comprises a luminous device configured to provide a primary light emitting area with a two-dimensional luminous flux density profile that imitates the image of at least a portion of the viewable side of the moon, thereby forming the moon appearance. The moon appearance generating system comprises further a frame structure providing an opening configured as an exit aperture through which the primary light emitting area can be seen.

In another aspect, a moon appearance generating system is configured for providing an enhanced depth perception to imitate a sky scene, for example, a natural sky scene at night. The moon appearance generating system comprises a luminous device with a primary light emitting area that is configured to provide, when the moon appearance generating system is operated to imitate the sky scene, a two-dimensional spatial profile of a luminous flux density across the primary light emitting area. The luminous flux density has a mean luminous flux density value of at least 5 lm/m2, and a maximum luminous flux density value of less than about 150000 lm/m2, wherein the mean luminous flux density value is at least 2% of the maximum luminous flux density value. The moon appearance generating system comprises further a frame structure for providing an exit aperture through which the primary light emitting area is completely viewable from within an enhanced depth perception observation range. The exit aperture is associated with an inner frame line that surrounds at least an area of 20 cm width and 20 cm height. The primary light emitting area is configured to be viewable along an optical main path and is perceived as having a shape selected from the group of shapes of moon phases comprising an essentially circular shape, a geometric lens-like shape comprising a first lens convex outer border portion extending along at least a quarter of a circle and a second lens convex outer border portion extending along less than a half circle, and a geometric lune-like shape comprising a convex lune outer border portion corresponding to at least a quarter of a circle and a concave lune outer border portion, and an optical main path length for light originating from the primary light emitting area until passing the exit aperture is at least about 0.3 m, such as 0.5 m. Thus, the luminous device may be configured to reproduce at least the shape of the moon as a not glaring area that is positioned behind a frame having an aperture through which the non glaring area can be seen.

Further embodiments of the above aspects, are disclosed in the dependent claims, which are incorporated herein by reference. For example, in some embodiments, the primary light emitting area is configured to have a shape that results, when being projected along an optical main path onto a frame front plane defined by the inner frame line, in an imitated moon radius of at least about 1 cm of the circular shape, the first lens convex outer border portion, or the convex lune outer border portion, respectively. The inner frame line may surround at least an area of 0.3 m width and 0.3 m height such as a rectangular shape having a side length of at least 0.35 m such as 0.5 m. The luminous device may comprise a secondary light emitting area that is configured to provide, when operated to imitate the sky scene, a star-like impression outside of the primary light emitting area.

In some embodiments, the luminous flux density profile comprises at least one low luminous flux density region with a mean low luminous flux density value lower than 90% of the maximum luminous flux density value such as 60% of the maximum luminous flux density value. In some embodiments, the luminous flux density profile comprises optionally at least one low luminous flux density region with a circular, in particular moon crater-like, shape, and/or at least 20% of the area of the primary light emitting area may have a luminous flux density below the mean luminous flux density value. Thereby, the luminous flux density profile in particular may resemble a crater scenery similar to the real moon. The mean luminous flux density value of the primary light emitting area may be in the range from about 5 lm/m2 to about 150000 lm/m2, preferably in the range from about 20 lm/m2 to about 50000 lm/m2, more preferably in the range from about 100 lm/m2 to about 15000 lm/m2.

In some embodiments, the luminance profile features—for at least one observer position within the enhanced depth perception observation range—the appearance of the moon, in particular in line with the naturally perceived lunar surface structure. The luminous device may be configured to be tunable in a color and/or in an intensity associated to the luminous flux density profile.

A luminous flux density measurement for the primary light emitting area may be performed in a plane orthogonal to the optical main path connecting the barycenter of the primary light emitting area and the barycenter of the area of the exit aperture.

In some embodiments, the moon appearance generating system comprises further a housing with an inner volume, which is optically coupled to the outside essentially only via the exit aperture of the frame structure. The housing optionally encloses the luminous device and/or at least one optical element for guiding the optical main path through the exit aperture. The housing may have an inner housing surface, which is configured to provide a substantially uniform background around the luminous device, in particular by comprising a substantially uniform absorption coefficient in the visible range. At least one portion of the inner housing surface may have an absorption coefficient in the visible range of at least 70%. The inner housing surface may be configured to provide a dark background around the luminous device.

Moreover, the frame structure may form a front side of the housing, e.g. a front wall section having therein the exit aperture.

In some embodiments, the moon appearance generating system comprises further a window unit that extends within the exit aperture of the frame structure such that the luminous device is visible only through the window element. The window unit may comprise at least one of a panel that is transparent in the visible range, an edge-lit diffusing panel being lit by a secondary light source to provide diffuse light being emitted from the exit aperture, a Rayleigh-like scattering layer being illuminated by the luminous device to provide diffuse light being emitted from the exit aperture, and a layer that acts as a diffuser, such as a low angle white light diffuser. In general, diffuse light being emitted from the exit aperture may have a correlated color temperature that is at least 1.5 (e.g. 1.5, 2, 2.5, or 3) times larger than a mean correlated color temperature of the light of the luminous device as seen through the exit aperture.

The luminous device may further comprise a primary light source unit for providing a directed light beam of visible light. Optionally the primary light source unit comprising a light emitting element and a beam forming unit. The luminous device may further comprise a mask unit that is configured to extend across the directed light beam in the near field and to form the primary light emitting area. The mask unit may comprise at least one absorbing element to locally absorb light and, optionally, to diffuse light, in order to produce the luminous flux density profile. The mask unit optionally comprise a diffuser element, e.g. upstream the at least one absorbing element, that is configured to locally increase the divergence across the directed light beam.

In some embodiments, the diffuser element and/or the at least one absorbing element provide a color such as red or amber to the intensity modulated light beam by absorption. The primary light source unit may be configured to provide a white and/or colored directed light beam.

The luminous device may further comprise an aperture element with an aperture in the shape of the primary light emitting area. The aperture element is optionally configured to imitate the lunar phases.

The moon appearance generating system may further comprise a positioning system for positioning the mask unit into or out of the light beam, and optionally a control unit for controlling the positioning system. In particular, the control unit may be configured to enable a positioning movement only in a switched-off mode of the luminous device.

Moreover, the image of the moon may be reproduced with realistic craters. In another embodiment the moon appearance generating system comprises a secondary light source for improving the depth perception by creating a sky-like diffuse light.

In line with the herein disclosed concepts, for reproducing the image of the moon (full or in another phase of the moon cycle), a light source may provide a luminous flux density in the range from about 5 lm/m2 to about 150000 lm/m2, preferably in the range from about 20 lm/m2 to about 50000 lm/m2, more preferably in the range from about 100 lm/m2 to about 15000 lm/m2. In some embodiments, the image of the moon is reproduced with details that are realistic when considering the resolution of an observer's eye at a standard observation distance from the light source, such as in the range from 5 m to 2 m with respect to the exit aperture. As an example, considering the fact that 0.07° can be considered as the angular resolution of the human eye, technical sub-structures may have a dimensions that is less than 1 mm. Moreover, the reproduced image of the moon may be configured in size by a light source having a diameter that is suitable proportioned to resemble the diameter of the real moon at a standard observation distance. In some embodiments, the angle subtended by the primary light emitting area may be less than one degree as for the real moon. In other embodiments, the reproduced image may be configured in size by having that same angle to be larger than one degree, such as up to 5° or 12°.

For creating the perception of "space" around the moon, the lighting system may comprise a housing that may be configured similar to the dark box disclosed in the above mentioned application WO 2014/076656 A1, which is incorporated herein by reference in its entirety. Then, a background around the moon imitation may be perceived as dark such as at least in a greyish or black color tone. The housing may define a preferred minimum distance of observation and a frame of observation for perceiving the imitation of the space-moon configuration.

In some embodiments, a suitable visible background (extending with the exit aperture provided by the frame structure) such as in a blue color tone may be alternatively provided. The luminous flux density may be large enough to be perceivable by eye. Although such a colored background may be perceived as being unnatural, a depth effect can be reached. A blue color tone may be generated using Rayleigh or Rayleigh-like scattering of incident white light. Alternatively or additionally, a secondary light source may be provided in the form of e.g. a diffuser panel that has a transmittance of T>0.5 in the visible range in thickness direction and that is illuminated with an edge illuminator that, for example, emits blue tinged light into the diffuser panel. Such an edge-lit diffuser panel can increase the effect of the depth perception. In some embodiments, the same material providing for the Rayleigh-like scattering may act as a light diffuser also for the light of the secondary light source.

The capability of an observer to evaluate the distance of objects, and therefore the depth of field of the views that constitute a three-dimensional scenery, is based on multiple physiological and psychological mechanisms. Physiological mechanisms relate, for example, to focusing, binocular convergence, binocular parallax, movement parallax, luminance, size, contrast, aerial perspective, etc. Some mechanisms may gain significance compared to the others according to both the observing conditions (e.g., whether the observer is moving or still, watching with one or two eyes, etc.) as well as the characteristics of the scenery. Those may depend, for example, on whether objects with known size, distance or luminance are present because those may serve as a reference to evaluate how distant the observed element of the scenery is.

Psychological mechanisms are significant for optical illusions and relate to what the brain is used to see. As long as the scene does not present an apparent inconsistency, the brain will interpret the physical data, in this application the light entering the eye, referring to a known situation. In this sense, the more the scene appears realistic, the more the brain is driven to believe the scene refers exactly to a well-known situation. As a consequence, some peculiar aspects of the scene, even if not present, not well defined or even conflicting, are automatically resolved by the brain subconsciously. In the present invention, the prime example of solved conflict is the fact that the image of the moon even if not focused by the eye at an infinite distance, is perceived as the moon being localized far away as in the real world.

In particular, the inventor realized that an observer, who is watching a realistic image of the moon through a frame, only with difficulty can estimate correctly how far away the image is. This is in particular the case if the background surrounding the image in the frame structure is uniform. The correct estimation of that distance is not trivial because of the knowledge that the real moon is at an infinite distance.

Further the inventor realized that the frame, which can be easily localized, may act a as reference without affecting the evaluation of the moon distance. The frame distance may be perceived much smaller than the moon distance, thus creating the effect of an aperture through which the real far away moon is visible.

The frame aperture may be a window element and may comprise one or more layers of different materials. In some embodiments, the window may be transparent. It is noted that a structure on the window element such as small scratches on its surface and/or a reflection of the room may help the localization of the window and, therefore, of the frame structure. In some embodiments, the window may comprise a ground glass or a diffuser that does not allow to completely recognize what is behind. The diffuser may be an holographic diffuser, a transparent panel comprising microparticles (having micrometer dimensions) or, simply, a scratched plastic panel.

In general, the luminous device may be surrounded by a dark, uniform background, which supports the observer's perception of the image of the moon virtually to be at infinite distance from him. The uniform background may also be of a color, be it a color of the sky in nature or an artificial sky scenery.

The inventor realized further that a large Rayleigh-like scattering panel can be positioned between an observer and a luminous device that reproduce the image of the moon so that the same is surrounded by a planar diffuse light source. The described perception may be increased when the balancing between the moon brightness and the diffuse light brightness are specifically balanced. In particular, a fine tuning of the involved brightness may enhance the perception. In some embodiments, the Rayleigh scattering of the light from the luminous device may be not sufficient to produce a significant amount of diffused light. Then, an additional light source (e.g. as in a side-lit embodiment) may be necessary to stress the presence of the diffused light.

Moreover, an additional diffusing panel may be used that can act as an additive source of diffused light. A certain embodiment may comprise, for example, a commercial diffuser suitable for side-lighting such as, e.g., "Acrylite® LED" or "Plexiglas® LED EndLighten" and an adequate (secondary to the moon) light emitting device such as a combination of multiple LEDs. That light source may create diffuse light that resembles the skylight. In some embodiments, the light source may comprise colored LEDs such as blue LEDs. In other embodiments, the light source may comprise colored and white LEDs. Furthermore, in some embodiments, the light source may comprise blue, red, green and white LEDs. In addition or alternatively, an OLED source or an OLED panel may be used.

The background effect may be interpreted as a consequence of the so-called "aerial perspective", a perception mechanism that is stressed by diffusion panels. For example, the color and intensity of diffused light may be virtually identical to the corresponding color and intensity of skylight, where intensity has to be evaluated as relative to the intensity of transmitted light. In particular, the so-called aerial perspective mechanism relates to the presence of an air layer interposed between any object and the observer; the color and luminance of such an air layer may affect the estimation of the object-to-observer distance, the object being perceived by the observer as lying behind the air layer itself; such mechanism is dominant when other psychophysic mechanisms for distance evaluation are suppressed or scarcely efficient.

The inventor further recognized that an observer is led to perceive light emitted by the diffusing panels as coming from a virtually infinite distance, provided that the moon is inside the observer's visual field. Such effect may be caused by the observer being hardly able to assess the real distance from the emitting planes of such luminous radiation due to the high spatial uniformity of luminous radiation itself. The uniformity does not provide any visual point of reference to look upon. Thus, the presence of the moon in the visual field affects the evaluation of the whole scenery's depth of field by "dragging" the estimated position of the diffusing panels beyond the threshold of distance perception by binocular convergence. Also, the effect of perceiving a diffused-light source at great distance from the observer is favored by the fact that light diffused by the panels has the color typical of skylight. Such effect, due to the aforementioned mechanism of aerial perspective, is particularly efficient, thereby causing the moon to be perceived at virtually infinite distance. The inventor also noticed that the described effect—the visual perception of an infinite depth of field (also called "breakthrough effect")—takes place irrespective of the direction of observation through the diffusing panels.

As already said, the real moon's structures are visible and recognizable. For the aim of recreating a realistic moon imitation, one should take into account that an image of the moon should be similar to the real moon. As a prime characteristic, the inventor recognized that the real moon shows a variable shape during the moon phases that include at least the circle, the lune and the lens, as geometrically described by the intersection of circles. The inventor further recognized that the true real moon shape can be approached with those three geometrical shape.

To increase the imitations, it will be appreciated that, in some embodiments, the moon image may be imitated by the addition of dark spots/regions on the bright surface, these resembling the presence of the crater-structure on the real moon. Thus, in some embodiments, the moon image may include more than one level of brightness, disposed in a way to mimic those real moon' structures. It will be understood that the most realistic image of the moon is a reproduction of a photograph of the moon or a similar image.

For completeness, it is noted that, for a given point of observation, a planar elliptic surface may appear to be round. Likewise, a planar image may not resemble the image of the moon, when observed perpendicularly, but may appear similar to the moon when observed from a tilted position. Thus, with respect to the shape, brightness, and structures used for the moon imitation, their configuration will be understood to relate to the optical main path associated with the observation of the primary light emitting area. In view of the geometric arrangement of the luminous source and the frame, a respective definition of the optical main path can be based on the barycenter of areas associated to those features. The geometrical arrangement that helps the enhanced depth perception may be expressed also in terms of the angle subtended by the frame when seen from the primary light emitting area.

Depending on the degree of imitation, the angular dimension of the image of the moon may appear as bigger than the expected or as without regular patterns or arrays or as composed by pixels.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1:
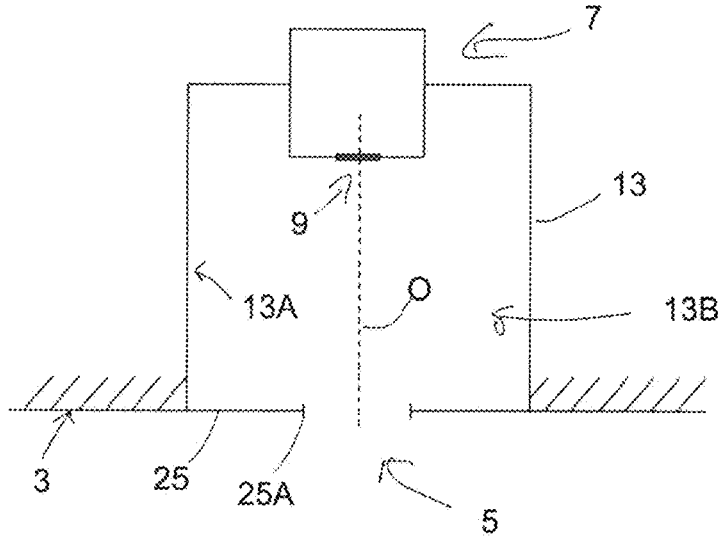
FIGS. 1 to 3 are schematic illustrations of moon appearance generating systems.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The disclosure is based in part on the realization that the moon provides a fundamental visual appearance effect onto the perception of a scene by a human observer. A moon-like luminous flux density profile was realized to contribute to the specific desired perception of e.g. a night sky scenery that is perceived by the observer with a specific depth effect. It was realized that not every illumination configuration or light source (even with the adequate low mean luminous flux density) will allow the creation of the depth effect.

In the following, various embodiments of moon appearance generating systems are disclosed in connection with FIGS. 1 to 3.

Figure 2:
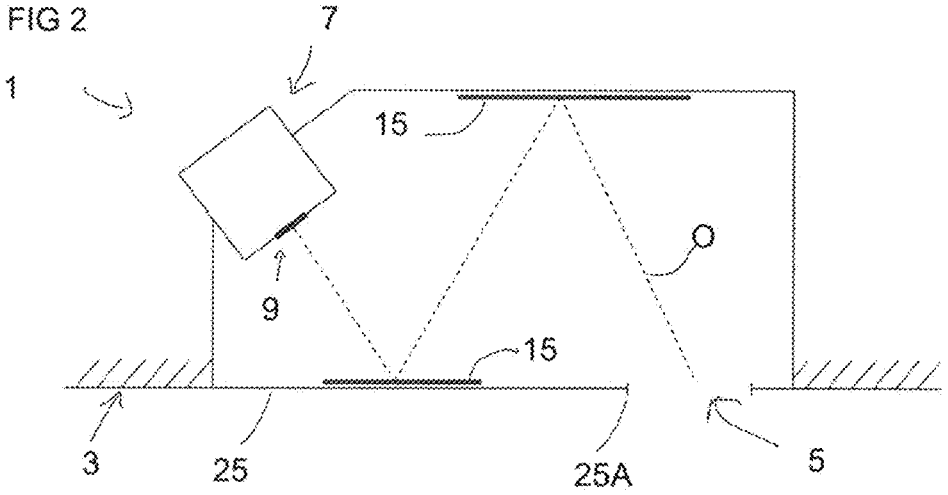
Figure 3:
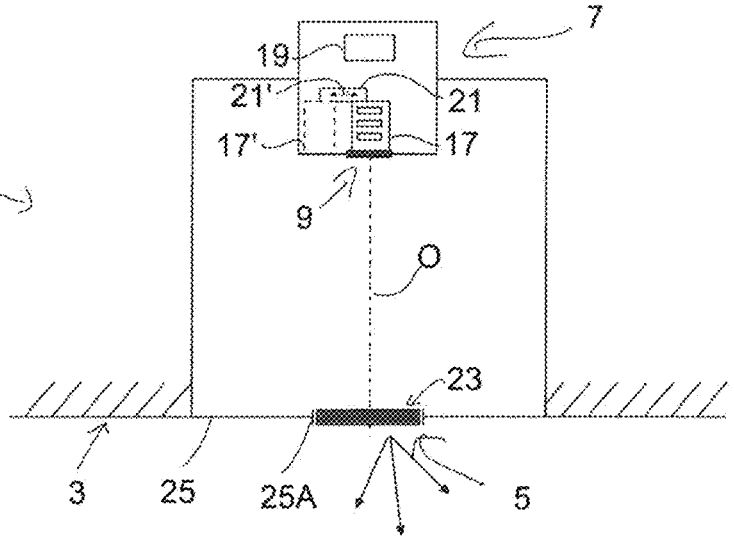

FIGS. 1 to 3 illustrate exemplary embodiments of moon appearance generating systems 1. Moon appearance generating systems 1 are configured such that an observer, when looking at the moon appearance generating systems 1, has the impression of looking at a sky scene, be it a natural sky scene, for example at night or dawn, or an unnatural sky scene with e.g. unusual colors.

In general, moon appearance generating systems 1 are mounted at a ceiling 3, for example, within a recess provided therein. When looking at ceiling 3, the observer will primarily recognize an exit aperture 5 that allows looking onto a luminous device 7. Luminous device 7 comprises a primary light emitting area 9. Primary light emitting area 9 can be seen through exit aperture 5, when an observer looks onto the moon appearance generating system 1 from within an enhanced depth perception observation range. Herein, the enhanced depth perception observation range is considered that range that allows seeing the complete primary light emitting area 9. In a transition range around the enhanced depth perception observation range, only a part of primary light emitting area 9 can be seen.

Figure 4:
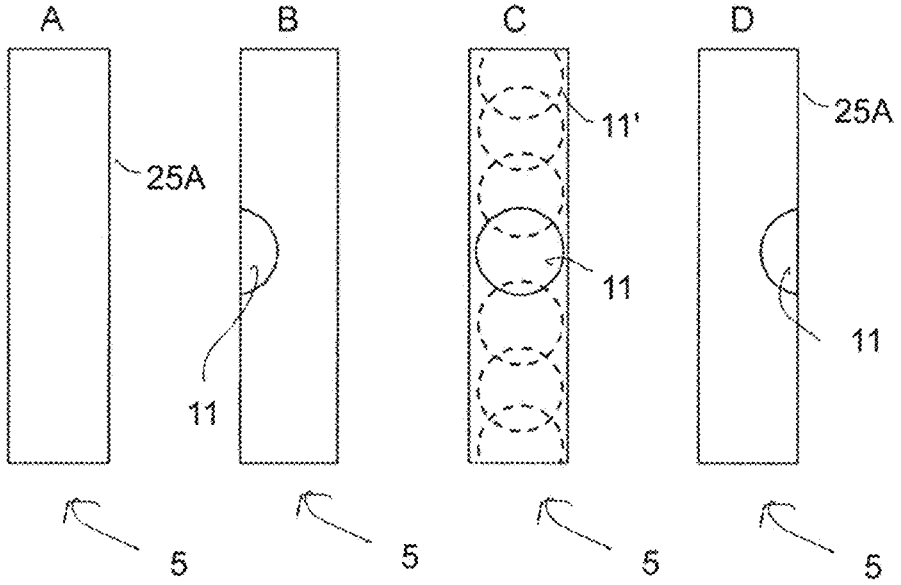
FIG. 4 is a schematic illustration of the perception of a full moon as imitated by a moon appearance generating system of any one of FIGS. 1 to 3.

For a moon appearance generating systems as disclosed herein, FIG. 4 with sections A to D illustrates how an observer perceives a primary light emitting area, e.g. a bright white circular area 11, if the moon appearance generating system is configured to imitate a full moon night scenery, when looking through rectangular exit aperture 5. Specifically, if the observer is outside of the enhanced depth perception observation range and outside of the transition range, the observer cannot see bright white circular area 11 as illustrated in FIG. 4, section A. Moving into the transition range, as shown in FIG. 4, section B, for example half of bright white circular area 11 can be seen. Accordingly, it is perceived that a full moon enters to the viewing range through exit aperture 5. As illustrated in FIG. 4, section C, the full moon will be completely viewable within the enhanced depth perception observation range assuming the respective distance from exit aperture 5. Assuming that the observer continues his movement from "left" to "right", the full moon imitation will move out of his field of view when entering the transition region on the other side. As shown in FIG. 4, section D, for example the other half of bright white circular area 11 (with respect to FIG. 4, section B) can be seen.

In contrast, for a movement along the long side of the rectangular shape of exit aperture 5 with the enhanced depth perception observation range, the moon appearance generating systems are configured such that the position of the moon moves within exit aperture 5 along the long side of the rectangular shape (dashed circles 11'). The specific optical configuration provides a perceived view to the observer that the same would have when looking through a sky window onto the far away real moon.

Returning to FIGS. 1 to 3, moon appearance generating systems 1 are configured such that primary light emitting area 9 is positioned with respect to exit aperture 5 such that a minimum optical path length of at least about 0.3 m for light originating from a barycenter of primary light emitting area 9 until passing through a barycenter of exit aperture 5 (i.e. along an optical main path O) is given. Primary light emitting area 9 extends essentially orthogonal with respect to optical main path O.

In the exemplary embodiment of FIG. 1, primary light emitting area 9 is positioned vertically above exit aperture 5. Exit aperture 5 is an opening into a housing 13 of moon appearance generating system 1. Housing 13 is, for example, configured to have a light absorbing inner side wall 13A such that the observer, when looking through exit aperture 5, only perceives primary light emitting area 9. As can be seen in FIG. 1, there is no optical element between primary light emitting area 9 and exit aperture 5.

In contrast, FIG. 2 illustrates an embodiment in which moon appearance generating system 1 has a folded configuration of optical main path O. Specifically, two mirrors 15 are used to redirect the light such that primary light emitting area 9 of luminous device 7 can be seen via reflections at mirrors 15. Accordingly, the embodiment of FIG. 2 can be configured to be more compact, e.g. thinner in extension beyond ceiling 3.

In the embodiment of moon appearance generating system 1 shown in FIG. 3, there are schematically indicated additional components of luminous device 7 such as a primary light source unit 19 and a mask unit 17 being positioned downstream of primary light source unit 19 as well as a schematic indication of a positioning system 21 (arrow 21' indicating the direction of movement) and a dashed box 17' indicating mask unit 17 being removed from the optical path.

In addition, the embodiment of FIG. 3 illustrates a window unit 23 being positioned within exit aperture 5 such that luminous device 7 and in particular primary light emitting area 9 is only visible through window element 23.

Referring to the above-mentioned application WO 2014/076656 A1, the optical conditions of housing 13 in FIGS. 1 to 3 may be configured in line with the therein disclosed black box configuration. For example, housing 13 comprises an inner volume 13B which is optically coupled to the outside, i.e. a room below ceiling 3, essentially only via exit aperture 5. Accordingly, the portion of housing 13 being viewable by an observer comprises a frame structure 25, in which exit aperture 5 is formed. Specifically, exit aperture 5 is associated with an inner frame line 25A defining the border of exit aperture 5. In FIG. 4, the inner frame line extends rectangular for the rectangular exit aperture 5.

To provide for the viewability of a moon in the size usually associated with the same, inner frame line 25A surrounds at least an area having a width of at least about 20 cm and a height of at least about 20 cm. With the respective size of exit aperture 5 then being big enough for seeing a primary light emitting area having a diameter of, for example, 5 cm being positioned about 0.5 m or more behind exit aperture 5—assuming that the observer is, for example, 1 m to 3 m away from exit aperture 5, as it would be the case in a usual indoor installations. That means, the respective size parameters for primary light emitting area 9 and exit aperture 5 are selected such that there is at least an enhanced depth perception observation range for an observer, from which the observer can see the complete primary light emitting area 9.

It will be appreciated by the skilled person that exit aperture 5 may be formed by a plurality of segments that are, for example, separated by some mounting grid structure. Assuming that the grid line thickness is small enough, the observer will still assume seeing the moon although through a grid.

Referring again to FIGS. 1 to 3, the dashed lines indicate a main optical path O with a length extending from a barycenter of light emitting area 9 to a barycenter of exit aperture 5. In general, a minimum optical path length associated with that main optical path, which is required to achieve enhanced depth perception, is at least 0.35 m. This minimum optical path length will result in the movement of the moon across exit aperture 5 as discussed before in connection with FIG. 4.

As mentioned, to achieve the depth effect for an observer, specific care has to be taken for the appearance of primary light emitting area 9. Specifically, an observer will associate primary light emitting area 9 with a structural element being close by, if the same is showing, for example, a technical sub-structure. For example, it was recognized that, when reducing the luminous flux density of a sunlight imitating lighting system as mentioned above to lower luminous flux density values, a sub-structure of the underlying light source will result in that the observer realizes that primary light emitting area 9 is associated with a light source. In contrast, if specific care is taken for the two-dimensional luminous flux density profile at the primary light emitting area, the observer will perceive the primary light emitting area 9 as a faraway object such as the moon. Specifically, it was realized that a two-dimensional luminous flux density profile of primary light emitting area 9 may have a mean luminous flux density value of at least 5 $lm/m^2$, a maximum luminous flux density of less than about 150000 $lm/m^2$, wherein at the same time the mean luminous flux density value is at least 2% of the maximum luminous flux density value. For example, the mean luminous flux density value of primary light emitting area 9 is in the range from about 5 lm/m2 to about 150000 lm/m2, preferably in the range from about 20 lm/m2 to about 50000 lm/m2, more preferably in the range from about 100 lm/m2 to about 15000 lm/m2. Accordingly, assuming that the mean luminous flux density value is not glaring, the observer will be able to look at and study primary light emitting area 9. In some embodiments, the luminous flux density value is lower than 2%, such as 0.5% of the maximum luminous flux density value. Although such a high contrast may slightly affect the perceived image of the moon as realistic, it may not affect the enhanced depth perception.

In the following, various approaches how to avoid an artificial appearance of primary light emitting area 9 are disclosed. In general, primary light emitting area 9 will be configured to be seen along an optical path with a moon-like shape such as an essentially circular shape (e.g. for full moon), a lens-like geometrical shape (e.g. for an almost full moon), or a geometric lune-like shape (e.g. for a crescent). As it is known, a geometric lens-like shape, which should resemble the real moon, may comprise a first lens convex outer border portion that extends along at least a quarter of circle and a second lens convex outer border portion that connects to the ends of the first lens convex outer border portion. For a moon larger than a half moon, the second lens convex outer border portion extends along less than a half circle. Similarly, a geometrical lune-like shape may comprise a convex moon outer border portion and a concave moon outer border portion. For the lens/lune-like geometrical shape, the convex moon outer border portion should correspond to at least a quarter of a circle such that the perceived moon shape can be clearly associated with a moon by an observer. In general, those moon-like shapes also include circular sector shapes and circular segment shapes being similarly approximations of moon shapes. With respect to an exemplary lens-like shape 30, it is referred to FIG. 5 and with respect to a geometric lune-like shape 40 it is referred to FIG. 7 for illustration purposes, while an essentially circular full moon is shown in FIG. 4.

Moreover, the following conditions may apply to a moon-like shape and luminous flux density: The luminous device may evoke the moon at least in that it is a non-glaring extended light source. The primary light emitting area may be non-uniform, in the sense that one part of the emitting area is brighter than the other part. The primary light emitting area may be bright showing one or more dark spots/areas. The above may result in a perceived image of the real moon as visible from earth.

As will be acknowledged, the above shapes relate to the various moon phases and, accordingly, are associated with a radius. Specifically, the full moon is associated with a radius of the essentially circular shape, the lens-like shape 30 is associated with a moon radius being the radius of the first lens convex outer border portion, and for the lune-like shape 40, the moon radius is associated with a convex moon outer border portion. As mentioned above, the dimension of the moon radius is at least 0.01 m (e.g. at least about 2.5 cm) such that the moon appearance generating system 1 generates a moon perception in the expected size of the moon in usual operating conditions.

It is noted that the shape of primary light emitting area 9 was referred to in view along the main optical path, i.e. in perception through exit aperture 5. The skilled person will acknowledge that, assuming the primary light emitting area being planar and extending, for example, orthogonally to the main optical path length, the delimiting shape on the surface of a housing of luminous device 7 associated with primary light emitting area 9 will have the above-discussed shapes. However, assuming that due to geometrical reasons of the optical system and/or housing 13, the delimiting shape on the surface of a housing of luminous device 7 may be angled with respect to a plane orthogonal to the main optical path or be non-planar therewith. Accordingly, a projection of the respective shape of primary light emitting area will need to be considered when associating the above-indicated shapes to luminous device 7.

The skilled person will further acknowledge that not always exact circular, exact lens or lune shapes may be needed, because the observer will not consider those deviations within some range, i.e. deformation of the natural moon shapes, in particular when not studying the moon in detail.

Accordingly, primary light emitting area 9 has a shape that results, when being projected along the optical main path onto a frame front plane defined by inner frame line 25A (e.g. by minimum deviation). In FIGS. 1 to 3, inner frame line 25A defines a plane that e.g. overlaps with the plane of ceiling 3. In that plane, the imitated moon radius may be in the above-mentioned range extending from at least about 0.01 m such as at least about 0.025 cm up to 0.25 m or more such as up to 0.5 m or more, e.g. 1 m.

Figure 5:
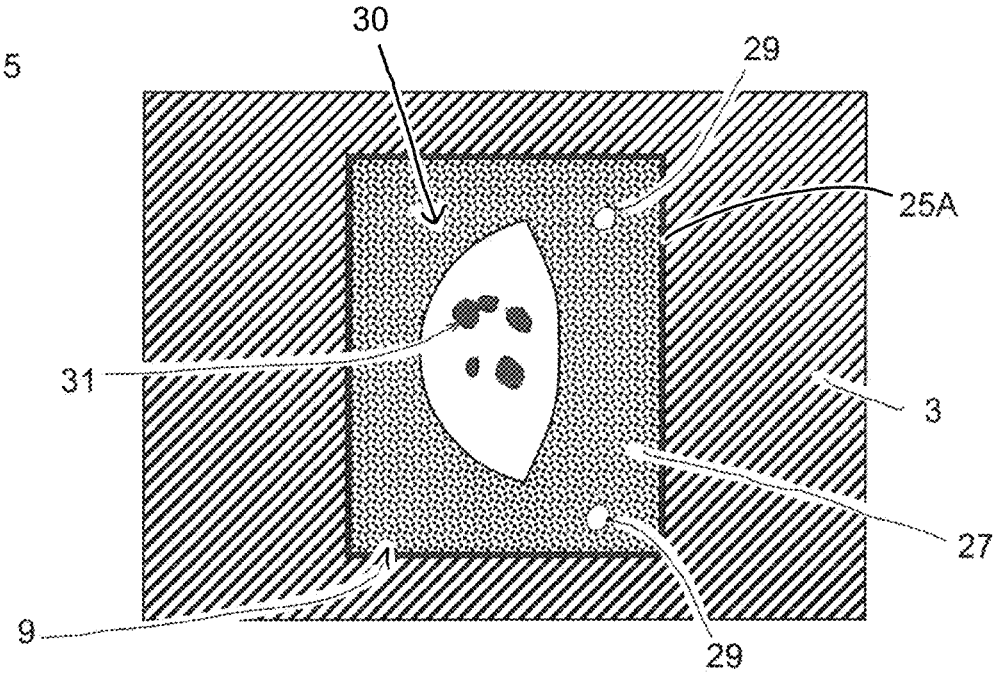
FIG. 5 is a schematic illustration of a lens-like moon imitation.

Referring to FIG. 5, a lens-like geometrical shape of the primary light emitting area 9 is shown to be surrounded by a homogenously perceived area 27 within ceiling 3. Homogenous perceived area 27 may be, for example, perceived purely black or have some grey scale color value, or, as will be discussed later in connection with FIG. 3, it may have some homogenous color such as an evening sky blue.

In addition, FIG. 5 illustrates localized secondary light emitting areas 29 that may be configured to provide a star-like impression outside of the primary light emitting area. Usually, also those secondary light emitting areas 29 will have a luminous flux density comparable to that of the moon, e.g. in the range of up to, for example, 150000 lm/m$^2$.

As can be further seen in FIG. 5, the exemplary primary light emitting area 9 comprises a two-dimensional luminous flux density profile with at least one low-luminous flux density region 31 having a mean-low luminous flux density value lower than 90% of the maximum luminous flux density value of the luminous flux density profile. For example, the luminous flux density profile may comprise one or more of circularly shaped low luminous flux density regions that represent crater-like the luminous flux density modulation associated with the moon's surface. In some embodiments, at least 20% of the area of primary light emitting area 9 may have a luminous flux density below the mean luminous flux density value. As illustrated in FIG. 5, the luminous profile can be configured to show a crater scenery similar to the one of the real moon.

It is noted that a luminous flux density measurement for primary light emitting area 9 would be performed in a plane orthogonal to the main optical path, which connects the barycenter of the primary light emitting are and the barycenter of the area of the exit aperture.

Figure 6:
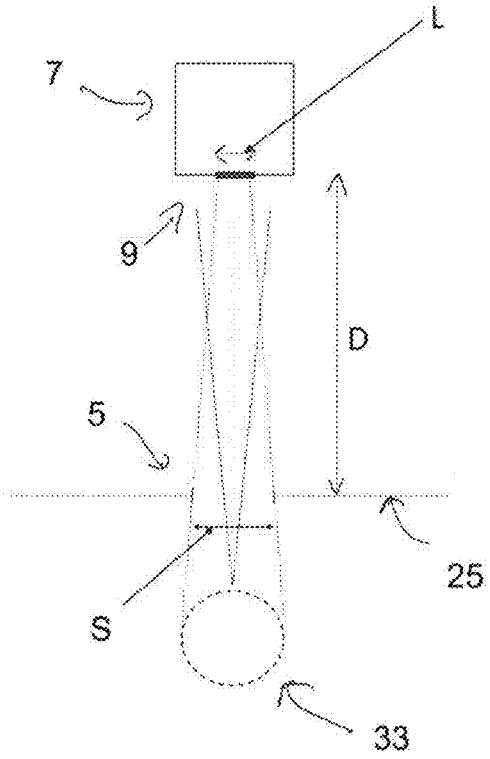
FIG. 6 is a schematic illustration of geometrical parameters used in the moon appearance generating systems.

As further illustrated in FIG. 6, the luminous flux density profile can be completely seen from within an enhanced depth perception observation range 33. Moreover, it will be appreciated that the luminous profile may feature for the observer positions within enhanced depth perception observation range 33 the appearance of the moon, in particular in line with a naturally perceived lunar surface structure. FIG. 6 further illustrates a minimum optical path length D (e.g. at least 0.35 m), a lateral extent L of primary light emitting area 9 (e.g. at least 0.01 m), wherein minimum optical path length D and lateral extent L are selected such that a perceived maximum size S of the imitated moon within enhanced depth perception observation range 33 is comparable to the perceived size of the real moon.

Referring again to FIGS. 1 to 3, housing 13 may at least partly enclose luminous device 7, and in particular surround primary light emitting area 9 as well as one or more optical elements used for guiding the light path from primary light emitting area 9 through exit aperture 5. As mentioned above, inner housing surface 13A may be configured to provide a substantially uniform background around the luminous device, in particular around primary light emitting area 9. For that purpose, housing surface 13A may comprise a substantially uniform absorption coefficient in the visible range such as an absorption coefficient of at least about 70%, at least within light subjected or perceivable portions of inner housing surface 13A.

Figure 7:
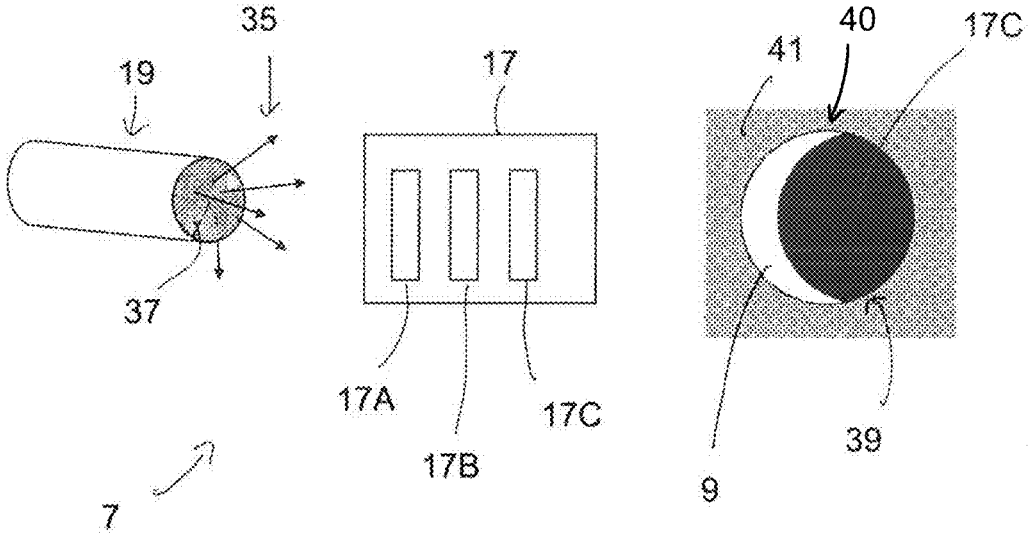
FIGS. 7 to 9 illustrate exemplary embodiments of a luminous device used in the moon appearance generating systems.
Figure 8:
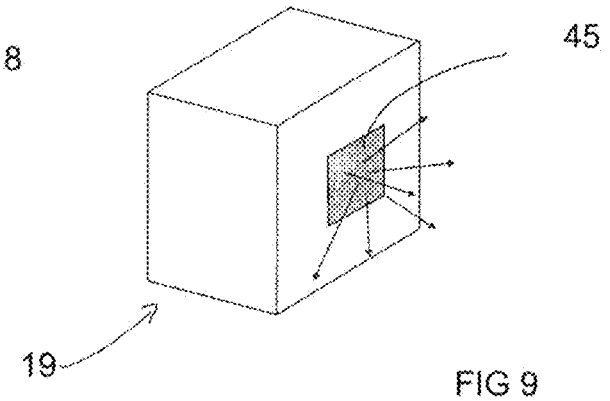
Figure 9:
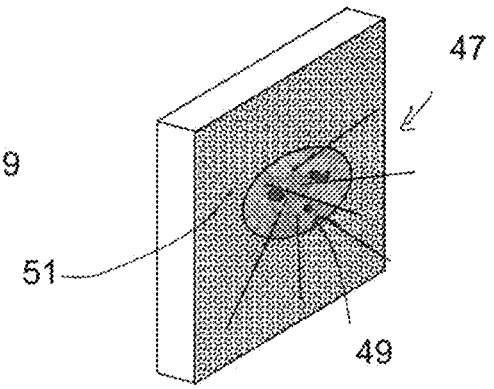

In connection with FIGS. 7 to 9, exemplary embodiments of luminous devices 7 are illustrated. In general, luminous device 7 may be configured as a light source that is shaped in its luminous profile by absorption (as illustrated in FIG. 7) or it may be configured as a device that already generates light having the required two-dimensional luminous flux density profile (as illustrated in FIG. 9).

For example, FIG. 7 illustrates schematically a primary light source unit 19 emitting a to some extent directed light beam 35 from a circular area 37, for example in a flat top profile as disclosed in the above-mentioned application WO 2015/172794 A1. Such a light source can, for example, be used as a sunlight imitating light source. However, when operating primary light source unit 19 to generate a luminous profile comparable to a moon, the underlying structure may be perceived. Accordingly, a mask unit 17 is positioned to extend across direct light beam 35 generated by primary light source unit 19. Primary light emitting area 9 is accordingly formed by mask unit 17 as shown on the right side of FIG. 7. Mask unit 17 may comprise a plurality of optical elements such as at least one diffuser element 17A, at least one absorbing element 17B, and/or at least one aperture element 17C.

Diffuser element 17A may be positioned upstream or downstream of absorbing element 17B. Furthermore, diffuser element 17A and absorbing element 17B may be implemented in a common structure. Specifically, diffuser element 17A is configured to increase locally the divergence of, for example, direct light beam 35 to wash out intensity modulations. Diffuser element 17A may comprise, for example, a transparent material with microparticles embedded therein, a holographic diffuser, a ground glass, and/or a frost-like material.

Absorbing element 17B is configured to locally absorb light and thereby create the two-dimensional luminous flux density profile in a pre-designed manner such as, for example, including crater-like features. The absorbing element 17B may be a transparent panel with ink, with a printed surface, with dots and the like.

In general, the diffuser element and the absorbing element may have, for example, a ballistic component of transmitted light.

Aperture element 17C may be positioned upstream or downstream of absorbing element 17B and/or diffuser element 17A and select only a portion of the direct light beam emitted from primary light source unit 19 to be emitted from luminous source 7 and then to be seen through exit aperture 5. For example, aperture element 17C may have an essentially circular, lens-like, or lune-like shaped opening (or be partially at one side shaped in that manner) to cut out a portion of direct light beam 35. As illustrated in FIG. 7 at the right side, a crescent shaped primary light emitting area 9 can be seen leaving a circular opening 39 within a front wall 41 of a housing of luminous device 7, wherein the crescent shape is generated by aperture element 17C being positioned with direct light beam 35.

As will be understood by the skilled person, using mask unit 17 is essentially independent from the shape of the light beam. For example, a square-shaped emitting area 45 of primary light source unit 19 is illustrated exemplarily in FIG. 8.

The primary light source unit in principle may provide (when operated without the mask) an enormous luminance. The mask, by absorbing the light, may take account of that. It will be understood that from a technical point of view, the primary objective of the mask is to produce the correct two-dimensional luminous profile, which may be performed in combination with a dimming of the primary light source unit. Any large scale absorption is a less efficient operation.

An alternative embodiment of a luminous device 7 is illustrated in FIG. 9. Specifically, luminous device 7 may be an electronic visual display that may allow generating the two-dimensional spatial profile of a luminous flux density across for imitating the moon (herein also referred to as screen). An exemplary screen is illustrated in FIG. 9 as an LCD flat screen 47. The screen visually displays an image 49 comprising a respective luminous flux density profile such as one of a moon or an approximation thereof. Image 49 may be, for example, surrounded by some black background 51.

Referring again to FIG. 3, mask unit 17 of FIG. 7 is schematically illustrated therein. Furthermore, as shown, mask unit 17 can be moved out of the direct light beam into a position 17' such that moon appearance generating system 1 of FIG. 3 can at the same time be operated at high luminance such as primary light source unit 19. The natural light is typically described as produced by the sun, on the other hand the moon presence is well known to light dark nights. Both are extended natural light sources (where extended means that are not point-like as the stars) but the characteristics are in fact different; as an example, considering the brightness, the typical ratio is one million. The luminous device as intended in the present invention relates directly to the image of the real moon. It is a matter of facts that the low moon brightness allows the precise and careful observation of its structure. This is an apparent difference between the moon and the sun as well is the fact that the moon image is not glaring.

In embodiments using that direct light beam for sun-sky imitation, window unit 23 may comprise a Rayleigh-like scattering layer that is illuminated by the luminous device and accordingly provides diffused blue light, assuming that primary light source unit 19 is a white light source. Then, also when the moon appearance generating system operated with low luminous flux density, some Rayleigh scattering may occur in window unit 23.

Additionally or alternatively, window unit 23 may comprise a panel that is transparent in the visible range and comprises, for example, some diffusing feature. This may, for example, generate an impression of the moon as seen through fog. It will be understood by a skilled person that the diffusing element may also help in hiding the technical sub-structures of the luminous device, thus obtaining/improving the enhanced depth perception. In embodiments, a ground glass may be included as a diffusing element.

Figure 10:
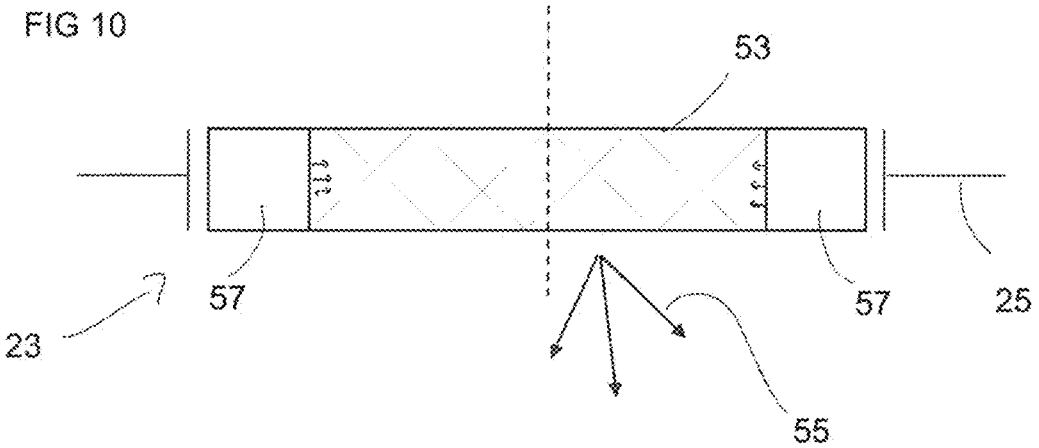
FIG. 10 is a schematic illustration of a side-lit panel implementation of a window unit.

As illustrated in FIG. 10, in addition or alternatively, window unit 23 may comprise an edge-lit diffusing panel 53. Edge-lit diffusing panel 53 is subject to light that is coupled into the panel from the sides and that is then scattered out of the diffusing panel as diffuse light 55. Accordingly, diffuse light 55 is emitted from edge-lit diffusing panel 53 into the room, i.e. diffuse light 55 will be perceived to be emitted from exit aperture 5 by an observer. In FIG. 10, secondary light sources 57 are used to couple light into edge-lit diffusing panel 53. The coupled light may be, for example, of natural blue color of the sky, thereby creating the impression of the white moon being perceived through the blue sky in a day-like or evening-like manner. Alternatively, edge-lit diffusing panel 53 may allow creating an unnatural background color surrounding the moon imitation. Assuming a homogeneity of diffuse light 55 across window unit 23, the depth perception may be enhanced.

In more simple configurations, a panel being transparent in the visible range may be used to protect the inside of housing 13 and create a window-like appearance.

It will be understood by the skilled person that, by using in particular the edge-lit diffusing panel, diffuse light may be generated having a correlated color temperature that is at least two times larger than a mean correlated color temperature of luminous device 7 as seen through exit aperture 5.

It will be further understood that the color of the perceived primary light emitting area 9 can further be modified by window unit 23 as well as mask unit 17 to be, for example, reddish or amber. For example, the direct light beam of primary light source unit 19 may experience some wavelength-dependent absorption. Alternatively, the primary light source unit may be configured to provide a white and/or colored emitting area.

As illustrated above, aperture element 17C may be configured to allow the imitation of one or more lunar phases by moving different portions or different aperture elements into the direct light beam. Accordingly, positioning system 21 may be configured to move the complete mask unit and/or only an aperture element into the beam.

For that purpose, a moon appearance generating system may comprise a control unit that is configured to control the positioning system. In particular, the control unit may enable a movement of the mask unit into or out of the direct light beam only in a switched-off mode of the luminous device.

Figure 11:
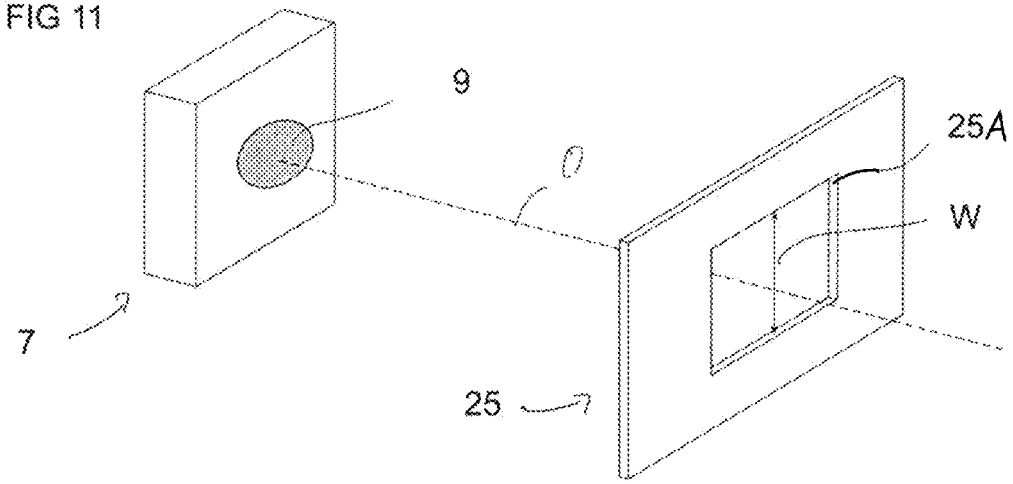
FIG. 11 is a schematic general illustration of a frame structure and its dimensional relation to a primary light emitting area of a luminous device.

FIG. 11 illustrates schematically frame structure 25 that can have any arbitrary shape as long as a minimum width W is given in any direction that allows seeing the complete primary light emitting area 9 (with respective lateral extent in two dimensions) of luminous device 7 from within a respective enhanced depth perception observation range.

The herein disclosed moon appearance generating system may be used as a luminous device that—like the natural moon—does not break the circadian rhythm. The moon appearance generating system, while providing for an infinite aperture similar to the mentioned sun imitating systems, may provide the same with a low power consumption.

It will be understood by the skilled person that the described luminous flux density is related to the luminance of the emitting area, these two values being connected by the angular emission profile, and summarized by the intensity profile. The described luminous flux densities may be related to luminance values taking into account the angular emission of the luminous device and the direction of observation.

For completeness, the luminous flux density, also known in literature as luminous emittance, is the luminous flux emitted by the unit area, and is measured in lm (lumens) per squared area (for example lm/m2). The flux density is proportional to the luminance of the same area if the emission pattern is Lambertian. Thus, the luminous flux density and the luminance can be linked by a measurement. Assuming a non-uniform emission pattern, an appropriate way for measuring the luminous flux density is to select the area of interest (e.g. by masking with a black metal from the remaining area) and to measure the luminous flux by usage of an integrating sphere. For the present moon implementation, the area of measurement should be chosen to be at least 1/10 of an associated moon radius.

Summarizing, an exemplary embodiment may have the features of 15 W consumption, 1500 cd/m2 mean luminance (max 4000 cd/m2) [respectively, and for a certain solid angle that may change, this can be written as 4500 lm/m2 and 12000 lm/m2], a circular shape with craters similar to real craters on the moon, tunability in color, a 2 m×1 m frame structure, a dark housing (e.g. >70% absorption) with mirrors for a compact set-up, an edge-lit Rayleigh-diffuser panel (or optionally an edge-lit diffuser), a CCT ratio of about 5, and a primary light source unit with mask (diffuser and absorption element) as well as optionally an aperture element and a device for allowing the positioning of the various optical elements.

Aspects of the Herein Disclosed Concepts Comprise

Aspect 1. A moon appearance generating system (1) for providing an enhanced depth perception to imitate a sky scene, for example, a natural sky scene at night, the moon appearance generating system (1) comprising:

a luminous device (7) with a primary light emitting area (9) that is configured to provide, when the moon appearance generating system (1) is operated to imitate the sky scene, a two-dimensional spatial profile of a luminous flux density across the primary light emitting area (9) with a mean luminous flux density value of at least 5 lm/m2, a maximum luminous flux density value of less than about 150000 lm/m2, wherein the mean luminous flux density value is at least 2% of the maximum luminous flux density value; and a frame structure (25) providing an exit aperture (5) through which the primary light emitting area (9) is completely viewable from within an enhanced depth perception observation range (33), wherein the exit aperture (5) is associated with an inner frame line (25A) that surrounds at least an area of 20 cm width and 20 cm height, and wherein the primary light emitting area (9) is configured to be viewable along an optical main path (O) and is perceived as having a shape selected from the group of shapes of moon phases comprising an essentially circular shape (11), a geometric lens-like shape (30) comprising a first lens convex outer border portion extending along at least a quarter of a circle and a second lens convex outer border portion extending along less than a half circle, and a geometric lune-like shape (40) comprising a convex lune outer border portion corresponding to at least a quarter of a circle and a concave lune outer border portion, and an optical main path length (L) for light originating from the primary light emitting area (9) until passing the exit aperture (5) is at least about 0.3 m, such as 0.5 m.

Aspect 2. The moon appearance generating system (1) of Aspect 1, wherein the primary light emitting area (9) is configured to have a shape that results, when being projected along an optical main path (O) onto a frame front plane defined by the inner frame line (25A), in an imitated moon radius of at least about 1 cm of the circular shape, the first lens convex outer border portion, or the convex lune outer border portion, respectively.

Aspect 3. The moon appearance generating system (1) of Aspect 1 or Aspect 2, wherein the inner frame line (25A) surrounds at least an area of 0.3 m width and 0.3 m height such as a rectangular shape having a side length of at least 0.35 m such as 0.5 m.

Aspect 4. The moon appearance generating system (1) of any one of the preceding Aspects, wherein the luminous device (7) comprises a secondary light emitting area (29) that is configured to provide, when operated to imitate the sky scene, a star-like impression outside of the primary light emitting area (9).

Aspect 5. The moon appearance generating system (1) of any one of the preceding Aspects, wherein the luminous flux density profile comprises at least one low luminous flux density region with a mean low luminous flux density value lower than 90% of the maximum luminous flux density value such as 60% of the maximum luminous flux density value, the luminous flux density profile comprises optionally at least one low luminous flux density region with a circular, in particular moon crater-like, shape, and/or at least 20% of the area of the primary light emitting area has a luminous flux density below the mean luminous flux density value, thereby in particular resembling a crater scenery similar to the real moon.

Aspect 6. The moon appearance generating system (1) of any one of the preceding Aspects, wherein the mean luminous flux density value of the primary light emitting area is in the range from about 5 lm/m2 to about 150000 lm/m2, such as in the range from about 20 lm/m2 to about 50000 lm/m2, for example, in the range from about 100 lm/m2 to about 15000 lm/m2.

Aspect 7. The moon appearance generating system (1) of any one of the preceding Aspects, wherein a luminous flux density measurement for the primary light emitting area (9) is performed in a plane orthogonal to the optical main path (O) connecting the barycenter of the primary light emitting area (9) and the barycenter of the area of the exit aperture (5).

Aspect 8. The moon appearance generating system of any one of the preceding Aspects, wherein the luminance profile features for at least one observer position within the enhanced depth perception observation range (33) the appearance of the moon, in particular in line with the naturally perceived lunar surface structure, and/or wherein the luminous device (7) is configured to be tunable in a color and/or in an intensity associated to the luminous flux density profile.

Aspect 9. The moon appearance generating system (1) of any one of the preceding Aspects, further comprising a housing (13) with an inner volume (13B), which is optically coupled to the outside essentially only via the exit aperture (5) of the frame structure (25) and optionally encloses the luminous device (7) and/or at least one optical element (15) for guiding the optical main path (O) through the exit aperture (5), and the housing (13) has an inner housing surface (13A), which is configured to provide a substantially uniform background around the luminous device (7), in particular by comprising a substantially uniform absorption coefficient in the visible range.

Aspect 10. The moon appearance generating system (1) of Aspect 9, wherein at least one portion of the inner housing surface (13A) has an absorption coefficient in the visible range of at least 70%, and/or the inner housing surface (13A) is configured to provide a dark background around the luminous device (7).

Aspect 11. The moon appearance generating system (1) of any one of the preceding Aspects, further comprising a window unit (23) extending within the exit aperture (5) of the frame structure (25) such that the luminous device (7) is visible only through the window element (23), and wherein the window unit comprises at least one of a panel that is transparent in the visible range;

an edge-lit diffusing panel being lit by a secondary light source to provide diffuse light being emitted from the exit aperture;

a Rayleigh-like scattering layer being illuminated by the luminous device to provide diffuse light being emitted from the exit aperture; and a layer that acts as a diffuser, such as a low angle white light diffuser.

Aspect 12. The moon appearance generating system (1) of Aspect 11, wherein diffuse light being emitted from the exit aperture (5) has a correlated color temperature that is at least 1.5 times larger than a mean correlated color temperature of the light of the luminous device (7) as seen through the exit aperture (5).

Aspect 13. The moon appearance generating system (1) of any one of the preceding Aspects, wherein the luminous device (7) further comprises a primary light source unit (19) for providing a directed light beam of visible light, optionally the primary light source unit (19) comprising a light emitting element and a beam forming unit; and a mask unit (17) configured to extend across the directed light beam in the near field and to form the primary light emitting area (9).

Aspect 14. The moon appearance generating system (1) of Aspect 13, wherein the mask unit (17) comprises at least one absorbing element (17B) to locally absorb light and, optionally, to diffuse light, in order to produce the luminous flux density profile, and/or wherein the mask unit comprise a diffuser element (17A), e.g. upstream the at least one absorbing element (17B), configured to locally increase the divergence across the directed light beam, and wherein optionally the diffuser element (17A) and/or the at least one absorbing element (17B) provide a color such as red or amber to the intensity modulated light beam by absorption, and/or wherein optionally the primary light source unit (19) is configured to provide a white and/or colored directed light beam.

Aspect 15. The moon appearance generating system (1) of any one of the preceding Aspects, wherein the luminous device (7) further comprises an aperture element (17C) comprising an aperture in the shape of the primary light emitting area (9), and wherein the aperture element (17C) is optionally configured to imitate the lunar phases; and/or the moon appearance generating system (1) further comprises a positioning system (21) for positioning the mask unit (17) into or out of the light beam, and optionally a control unit for controlling the positioning system (21), and in particular for enabling a positioning movement only in a switched-off mode of the luminous device (7).

Although the preferred embodiments of this invention have been described herein, improvements and modifications may be incorporated without departing from the scope of the following claims.

The invention claimed is:

1. A moon appearance generating system for providing an enhanced depth perception to imitate a sky scene, the moon appearance generating system comprising:

a luminous device with a primary light emitting area that is configured to provide, when the moon appearance generating system is operated to imitate the sky scene, a two-dimensional spatial profile of a luminous flux density across the primary light emitting area with a mean luminous flux density value of at least 5 lm/m2, a maximum luminous flux density value of less than about 150000 lm/m2, wherein the mean luminous flux density value is at least 2% of the maximum luminous flux density value, wherein the luminous device comprises a primary light source unit configured to provide a directed light beam of visible light; and a mask unit configured to extend across the directed light beam in the near field and to form the primary light emitting area, wherein the mask unit comprises at least one absorbing element configured to locally absorb light and a diffuser element configured to locally increase the divergence across the directed light beam, such that the luminous flux density profile comprises at least one low luminous flux density region with a mean low luminous flux density value lower than 90% of the maximum luminous flux density value, and at least 20% of the area of the primary light emitting area has a luminous flux density below the mean luminous flux density value, and a frame structure providing an exit aperture through which the primary light emitting area is completely viewable from within an enhanced depth perception observation range, wherein the exit aperture is associated with an inner frame line that surrounds at least an area of 20 cm width and 20 cm height, and wherein the primary light emitting area is configured to be viewable along an optical main path and a projection of the primary light emitting area along the optical main path onto a frame front plane defined by the inner frame line has a shape of a moon phase, and an optical main path length for light originating from the primary light emitting area until passing the exit aperture is at least about 0.3 m, or at least about 0.5 m.

2. The moon appearance generating system of claim 1, wherein the shape of a moon phase is a first geometric shape comprising a first lens convex outer border portion extending along at least a quarter of a circle and a second lens convex outer border portion extending along less than a half circle, and/or the first geometric shape is surrounded by a background, which extends within the exit aperture, or a second geometric shape comprising a convex lune outer border portion corresponding to at least a quarter of a circle and a concave lune outer border portion, and/or the second geometric shape is surrounded by a background, which extends within the exit aperture.

3. The moon appearance generating system of claim 1, wherein the shape of a moon phase is an essentially circular shape, and/or the shape of a moon phase is an essentially circular shape surrounded by a background, which extends within the exit aperture.

4. The moon appearance generating system of claim 2, wherein the primary light emitting area is configured to have a shape that results, when being projected along an optical main path onto a frame front plane defined by the inner frame line, in an imitated moon radius of at least about 1 cm of the circular shape, the first lens convex outer border portion, or the convex lune outer border portion, respectively.

5. The moon appearance generating system of claim 1, wherein the luminous flux density profile comprises at least one low luminous flux density region with a mean low luminous flux density value lower than 60% of the maximum luminous flux density value, and/or wherein the luminous flux density profile comprises at least one low luminous flux density region with a circular shape and/or a shape resembling a moon crater.

6. The moon appearance generating system of claim 1, further comprising a window unit extending within the exit aperture of the frame structure such that the luminous device is visible only through the window element, and wherein the window unit comprises at least one of a panel that is transparent in the visible range;

an edge-lit diffusing panel being lit by a secondary light source to provide diffuse light being emitted from the exit aperture;

a Rayleigh scattering layer being illuminated by the luminous device to provide diffuse light being emitted from the exit aperture; and a layer configured to diffuse light or a low angle white light diffuser.

7. The moon appearance generating system of claim 6, wherein diffuse light being emitted from the exit aperture has a correlated color temperature that is at least 1.5 times larger than a mean correlated color temperature of the light of the luminous device exiting the exit aperture.

8. The moon appearance generating system of claim 1, wherein the primary light source unit comprises a light emitting element and a beam forming unit.

9. The moon appearance generating system of claim 8, wherein at least one of the at least one absorbing element is configured to diffuse light, in order to produce the luminous flux density profile or a two-dimensional luminous flux density profile in a pre-designed manner including crater-like features, the at least one absorbing element is a transparent panel with ink, with a printed surface including a pattern, array, or arrangement of geometric shapes, and the at least one absorbing element is configured to reproduce a realistic image of the moon.

10. The moon appearance generating system of claim 1, wherein at least one of the diffuser element is positioned upstream or downstream of the at least one absorbing element, the diffuser element and/or the at least one absorbing element provide a color to the intensity modulated light beam by absorption, and/or are implemented in a common structure, the primary light source unit is configured to provide a white and/or colored directed light beam, and the diffuser element comprises a transparent material with microparticles embedded therein, a holographic diffuser, a ground glass, and/or a low angle diffusing material.

11. The moon appearance generating system of claim 1, wherein the primary light source unit is configured for emitting the directed light beam from a circular area in a flat top profile.

12. The moon appearance generating system of claim 1, wherein the luminous device comprises a secondary light emitting area that is configured to provide, when operated to imitate the sky scene, a star-like impression outside of the primary light emitting area.

13. The moon appearance generating system of claim 1, wherein the mean luminous flux density value of the primary light emitting area is in the range from about 20 lm/m2 to about 50000 lm/m2 or in the range from about 100 lm/m2 to about 15000 lm/m2.

14. The moon appearance generating system of claim 1, wherein a luminous flux density measurement for the primary light emitting area is performed in a plane orthogonal to the optical main path connecting the barycenter of the primary light emitting area and the barycenter of the area of the exit aperture.

15. The moon appearance generating system of claim 1, wherein at least one of the luminance profile features the appearance of the moon for at least one observer position within the enhanced depth perception observation range, and the luminous device is configured to be tunable in a color and/or in an intensity associated to the luminous flux density profile.

16. The moon appearance generating system of claim 1, further comprising a housing with an inner volume, which is optically coupled to the outside essentially only via the exit aperture of the frame structure and/or encloses the luminous device and/or at least one optical element for guiding the optical main path through the exit aperture, and the housing has an inner housing surface, which is configured to provide a substantially uniform background around the luminous device and/or a substantially uniform background coefficient in the visible range.

17. The moon appearance generating system of claim 16, wherein at least one of at least one portion of the inner housing surface has an absorption coefficient in the visible range of at least 70%, and the inner housing surface is configured to provide a dark background around the luminous device.

18. The moon appearance generating system of claim 1, wherein the luminous device further comprises an aperture element comprising an aperture in the shape of the primary light emitting area, and/or wherein the aperture element is configured to imitate the lunar phases.

19. The moon appearance generating system of claim 1, further comprising at least one of a positioning system configured to position the mask unit into or out of the light beam, and a control unit configured to control the positioning system, and/or to enable a positioning movement only in a switched-off mode of the luminous device.

20. The moon appearance generating system of claim 19, wherein the primary light source unit is configured to provide the directed light beam of visible light imitating the sun, when working at maximum power, and wherein, when the primary light source unit is dimmed and the absorbing element is positioned to extend across the dimmed directed light beam, a sky scene with the perceived moon is imitated.

21. A moon appearance generating system for providing an enhanced depth perception to imitate a sky scene, the moon appearance generating system comprising:

a luminous device with a primary light emitting area that is configured to provide, when the moon appearance generating system is operated to imitate the sky scene, a two-dimensional spatial profile of a luminous flux density across the primary light emitting area with a mean luminous flux density value of at least 5 lm/m2, a maximum luminous flux density value of less than about 150000 lm/m2, wherein the mean luminous flux density value is at least 2% of the maximum luminous flux density value;

a frame structure configured to provide an exit aperture through which the primary light emitting area is completely viewable from within an enhanced depth perception observation range, wherein the exit aperture is associated with an inner frame line that surrounds at least an area of 20 cm width and 20 cm height; and a window unit extending within the exit aperture of the frame structure such that the luminous device is visible only through the window element, and wherein the window unit comprises an edge-lit diffusing panel being lit by a secondary light source to provide diffuse light being emitted from the exit aperture, wherein the primary light emitting area is configured to be viewable along an optical main path and a projection of the primary light emitting area along the optical main path onto a frame front plane defined by the inner frame line has a shape selected from the group of shapes of moon phases comprising an essentially circular shape, a first geometric shape comprising a first lens convex outer border portion extending along at least a quarter of a circle and a second lens convex outer border portion extending along less than a half circle, and a second geometric shape comprising a convex lune outer border portion corresponding to at least a quarter of a circle and a concave lune outer border portion, and an optical main path length for light originating from the primary light emitting area until passing the exit aperture is at least about 0.3 m or at least about 0.5 m.

22. The moon appearance generating system of claim 21, wherein the edge-lit diffusing panel creates at least one of homogeneous diffuse light thereby improving depth perception;

the diffuse light with a blue color tone such that the moon appearance generating system creates a natural scene of a day sky with visible moon;

inhomogeneous diffuse light such that the moon appearance generating system creates a natural scene at dawn or dusk; and diffuse light with a color tone chosen such that the moon appearance generating system creates an unnatural scene.

23. The moon appearance generating system of claim 21, wherein the primary light emitting area is configured to have a shape that results, when being projected along an optical main path onto a frame front plane defined by the inner frame line, in an imitated moon radius of at least about 1 cm of the circular shape, the first lens convex outer border portion, or the convex lune outer border portion, respectively.

24. The moon appearance generating system claim 21, wherein at least one of the luminous flux density profile comprises at least one low luminous flux density region with a mean low luminous flux density value lower than 90% of the maximum luminous flux density value such as 60% of the maximum luminous flux density value, the luminous flux density profile comprises optionally at least one low luminous flux density region with a circular, in particular and/or moon crater-like, shape, and at least 20% of the area of the primary light emitting area has a luminous flux density below the mean luminous flux density value.

25. The moon appearance generating system claim 21, wherein the window unit further comprises at least one of a panel that is transparent in the visible range;

a Rayleigh scattering layer being illuminated by the luminous device to provide diffuse light being emitted from the exit aperture; and a layer configured to diffuse light or a low angle white light diffuser.

26. The moon appearance generating system claim 21, wherein at least one of the window unit comprises, in addition to the edge-lit diffusing panel, a Rayleigh scattering layer illuminated by the luminous device to provide diffuse light being emitted from the exit aperture;

the edge-lit diffusing panel is configured to provide diffused light having an intensity that is at least equal to the intensity of the light, which is produced by the primary light emitting area and which is scattered by the Rayleigh scattering layer, and the edge-lit diffusing panel is configured to provide diffused light having an intensity that is larger than two times the intensity of the light, which is produced by the primary light emitting area and scattered by the Rayleigh scattering layer.

27. The moon appearance generating system of claim 26, wherein diffuse light being emitted from the exit aperture has a correlated color temperature that is at least 1.5 times larger than a mean correlated color temperature of the light of the luminous device exiting through the exit aperture (5).

28. The moon appearance generating system claim 21, wherein the luminous device further comprises a primary light source unit configured to provide a directed light beam of visible light or a primary light source unit comprising a light emitting element and a beam forming unit; and a mask unit configured to extend across the directed light beam in the near field and to form the primary light emitting area.

29. The moon appearance generating system of claim 28, wherein at least one of the mask unit comprises at least one absorbing element configured to locally absorb light and/or to diffuse light, in order to produce the luminous flux density profile, the mask unit comprises a diffuser element arranged upstream or downstream the at least one absorbing element and configured to locally increase the divergence across the directed light beam, the diffuser element and/or the at least one absorbing element provide a color to the intensity modulated light beam by absorption, and/or are implemented in a common structure, the primary light source unit is configured to provide a white and/or colored directed light beam, and the diffuser element comprises a transparent material with microparticles embedded therein, a holographic diffuser, a ground glass, and/or a frost-like material.

30. The moon appearance generating system of claim 21, wherein the inner frame line surrounds at least an area of 0.3 m width and 0.3 m height.

* * * * *